US005249331A

United States Patent [19]

Mitani et al.

[11] Patent Number: 5,249,331

[45] Date of Patent: Oct. 5, 1993

[54] VACUUM CLEANER FLOOR NOZZLE HAVING AN AUXILIARY AGITATOR

[75] Inventors: Tomomi Mitani, Yokaichi; Hiroshi Nishimura; Hiroshi Hayakawa, both of Gamo; Hiroshi Mori, Yokaichi; Tomonori Katoh, Yokaichi; Hideo Okubo, Yokaichi; Hidenori Kitamura, Gamo; Haruhisa Miyake, Kanzaki; Kiyokazu Uno, Echi, all of Japan

[73] Assignee: Matsushita Elecric Industrial Co., Ltd., Osaka, Japan

[21] Appl. No.: 789,335

[22] Filed: Nov. 8, 1991

[30] Foreign Application Priority Data

Nov. 9, 1990 [JP] Japan ..... 2-305144
Nov. 9, 1990 [JP] Japan ..... 2-305145
Nov. 9, 1990 [JP] Japan ..... 2-305146

[51] Int. Cl.[5] ..... A47L 9/04

[52] U.S. Cl. ..... 15/363; 15/42; 15/375

[58] Field of Search ..... 15/42, 375, 363, 366, 15/368, 383, 384, 364

[56] References Cited

U.S. PATENT DOCUMENTS

| | | | |
|---|---|---|---|
| 436,689 | 9/1890 | Boggs | 15/42 |
| 601,628 | 4/1898 | Browne | 15/42 |
| 604,783 | 5/1898 | Parbel et al. | 15/42 |
| 866,640 | 9/1907 | Friedman | 15/42 |
| 4,355,436 | 10/1982 | Hertzberg | 15/383 |
| 4,854,006 | 8/1989 | Nishimura et al. | 15/42 X |

FOREIGN PATENT DOCUMENTS

| | | | |
|---|---|---|---|
| 0285096 | 10/1988 | European Pat. Off. . | |
| 2229967 | 1/1974 | Fed. Rep. of Germany . | |
| 490784 | 8/1938 | United Kingdom | 15/42 |
| 2046087 | 11/1980 | United Kingdom . | |

*Primary Examiner*—Stephen F. Gerrity
*Attorney, Agent, or Firm*—Wenderoth, Lind & Ponack

[57] ABSTRACT

A floor nozzle for a vacuum cleaner of the present invention has an auxiliary agitator provided outside the lateral wall of a main body of the nozzle. The auxiliary agitator is covered by a protecting cover, so as to ensure safety during use. Moreover, a stirring member, a dust outlet and confirmation holes allow dust to be discharged out of the main body more easily and smoothly, while preventing burning or breaking of the agitator.

24 Claims, 7 Drawing Sheets

VACUUM CLEANER FLOOR NOZZLE HAVING AN AUXILIARY AGITATOR

BACKGROUND OF THE INVENTION

1. Field of the Invention

The present invention relates to a floor nozzle for a vacuum cleaner having a sub-agitator provided outside the lateral wall of a nozzle main body for convenience in cleaning the corner of a room.

2. Description of the Prior Art

A sub-agitator is coaxially fixed with a main agitator in a floor nozzle of a conventional vacuum cleaner. The sub-agitator (or auxiliary agitator) is placed outside the lateral wall of a main body of the nozzle. The sub-agitator is constituted by a stirring member, for example, a brush or the like extending radially from the outer peripheral surface of a circular rotary body.

Therefore, the floor nozzle of the above-described type allows cleaning of even the corner of a room.

However, since the sub-agitator is provided outside the lateral wall of the main body of the nozzle in the above structure of the conventional vacuum cleaner, a user might inadvertently touch the sub-agitator during use and get hurt. Moreover, the dust raked out from a surface to be cleaned will accumulate in a gap between the lateral wall of the nozzle main body and the sub-agitator, and will burden the rotation of the sub-agitator and result in burning or breakage of a driving source, e.g., a motor or a transmission belt. If the rotary body of the sub-agitator is made of synthetic resin, the resin will sometimes melt due to friction between the gathering dust.

SUMMARY OF THE INVENTION

The object of the present invention is therefore to provide an improved floor nozzle for a vacuum cleaner, with the intention of improving the operational safety and operating efficiency during the rotation of an agitator.

In order to achieve the aforementioned object, according to the present invention, a main agitator driven by a driving source is built in the main body of a nozzle and, a sub-agitator (or auxiliary agitator) for cleaning the corner is rotated interlockingly with the main agitator and is provided outside the lateral wall of the nozzle main body. The sub-agitator is constituted by a stirring member projecting radially from the outer periphery of a circular rotary body. A protecting cover with a plurality of confirmation holes is mounted to the main body outside the sub-agitator.

According to a second aspect of the present invention, a dust outlet is formed at the central part of the protecting cover outside the sub-agitator.

According to a third aspect of the present invention, the dust outlet is shifted to the rotational center of the sub-agitator.

According to a fourth aspect of the present invention, an edge of the dust outlet is formed straight.

According to a fifth aspect of the present invention, a protruding part is provided in the outer periphery of the rotary body inwardly of the stirring member to rake out the dust.

According to a sixth aspect of the present invention, the protruding part is integrally formed in the outer periphery of the rotary body in the form of a rib.

According to a seventh aspect of the present invention, the protruding part is twisted to move the dust outside.

According to an eighth aspect of the present invention, an end of the protruding part at the upper side in the rotational direction is sharpened.

According to a ninth aspect of the present invention, the protruding part is made of metal.

With the above-described structure of the vacuum cleaner, careless touching of the sub-agitator can be prevented by the protecting cover. Although the dust can easily gather in a gap between the protecting cover and the sub-agitator, it can be removed smoothly when necessary through the confirmation holes or dust outlet. Moreover, the dust passing through the dust outlet is cut into small pieces by the protruding part.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 13(*b*) is a partial front view of the second modified sub-agitator.

DETAILED DESCRIPTION OF THE PREFERRED EMBODIMENT

A preferred embodiment of the present invention will be described hereinbelow with reference to the accompany drawings.

Figure 1:
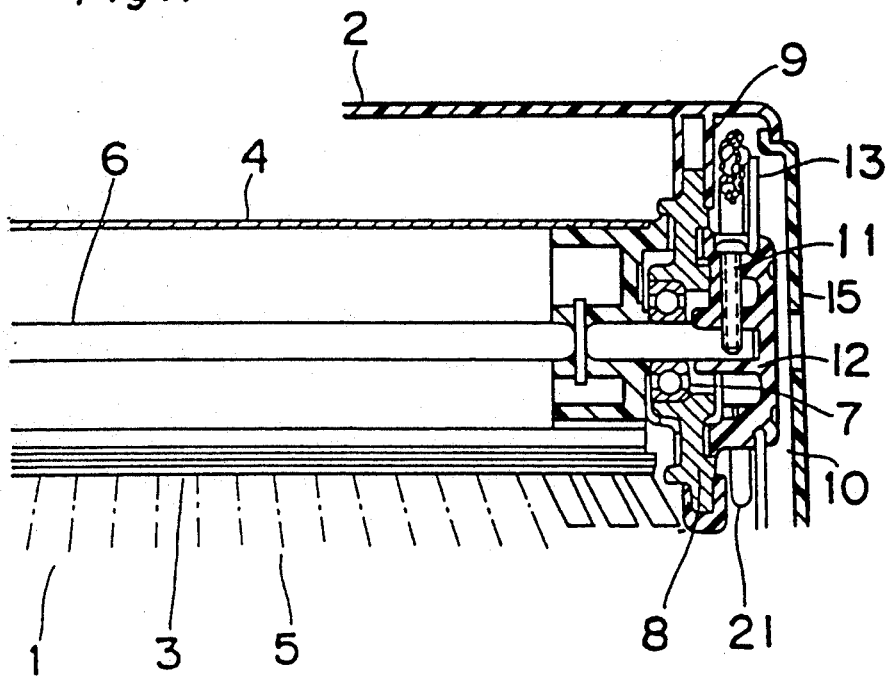
FIG. 1 is a cross-sectional view of a part of a floor nozzle according to the present invention.
Figure 3:
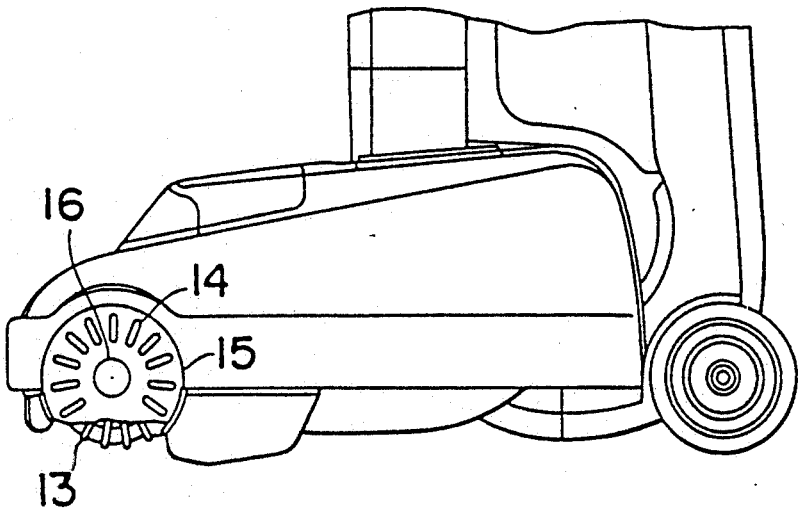
FIG. 3 is a side elevation view of the floor nozzle.
Figure 2:
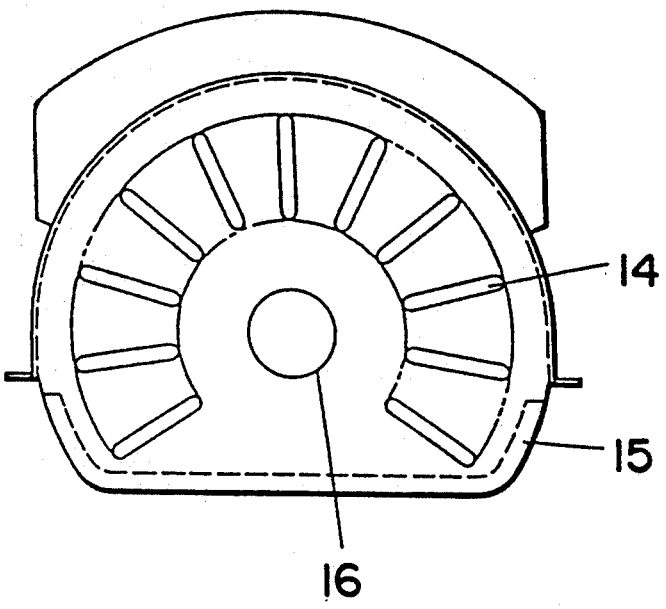
FIG. 2 is a front elevation view of a protecting cover.

Referring to FIGS. 1–3, a main body 2 of a floor nozzle of the present invention has a nozzle 1 at the bottom thereof and a main agitator 3 extending in a lateral direction thereinside. The main agitator 3 is composed of a stirring member 5, such as a brush or an elastic belt-shaped body, arranged at the outer peripheral surface of a rotary cylinder 4. A part of the stirring member 5 faces outside from the nozzle 1. A shaft 6 passing through the center of the rotary cylinder 4 is supported by a bearing unit 8 which has a ball bearing 7.

An end of the shaft 6 protrudes outside from a lateral wall 9 of the main body 2. The main agitator 3 is rotated by a driving source, for example, a motor or an air turbine.

A sub-agitator (or auxiliary agitator) 10 is provided at the end of the shaft 6, namely, outside the lateral wall 9 of the main body 2. The sub-agitator 10 consists of a circular rotary body 12 made of synthetic resin and fixed to the shaft 6 via a screw 11, and a stirring member 13 made of a brush or the like. An end of the outer periphery of the stirring member 13 is inclined slightly outward. A plurality of slits forming confirmation holes 14 are formed in a radial direction of an auxiliary protecting cover 15 which is mounted to the main body 2 and covers the outer side of the sub-agitator 10 (as shown in FIGS. 1 and 3).

The opening area of each confirmation slit 14 is set so as to prevent insertion of a child's finger. Moreover, since the lower part of the protecting cover 15 is formed approximately straight, the lower part of the sub-agitator 10 is exposed from the protecting cover 15. A round dust outlet 16 is formed at the center of the protecting cover 15.

The main agitator 3 scrapes dust from a surface to be cleaned, e.g. a carpet, towards the nozzle 1 of the main body 2. The dust is finally guided to a filter part while floating in a passage within the main body 2 and an extension wand or a hose by the suction force of the vacuum cleaner.

When the corner of a room is to be cleaned, one has only to let the sub-agitator 10 run along the corner.

Since the outside of the sub-agitator 10 is covered with the protecting cover 15, an infant is prevented from touching the stirring member 13 of the sub-agitator 10, to thereby ensure the safety of the infant or user, etc.

Although the scraped dust may partly enter a gap between the sub-agitator 10 and the protecting cover 15, in the above structure of the present embodiment, it can be confirmed from outside through the confirmation slits 14 of the protecting cover 15 how much of the dust has collected. Therefore, the dust can be removed properly.

Figure 4:
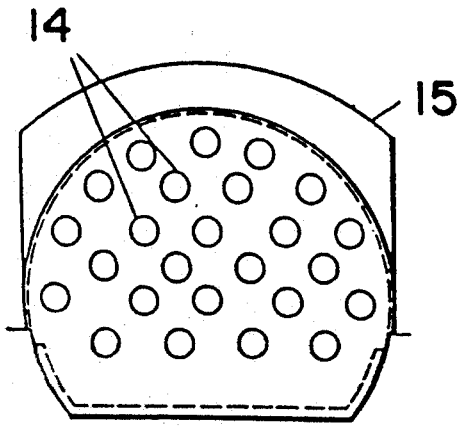
FIG. 4 is a front elevation view of a first modified protecting cover.

The shape of each of the confirmation holes 14 of the protecting cover 15 is not limited to a slit, but may be a round hole as indicated in FIG. 4. It is needless to say, however, that the opening area of each hole should be set to avoid erroneous insertion of a finger.

The dust outlet 16 formed at the center of the protecting cover 15 allows the dust in the gap between the protecting cover 15 and sub-agitator 10 to exit therefrom. Even if the dust is accumulated in the gap, the presence of the dust can be confirmed through the confirmation holes 14, and therefore can be removed from the gap.

Figure 5:
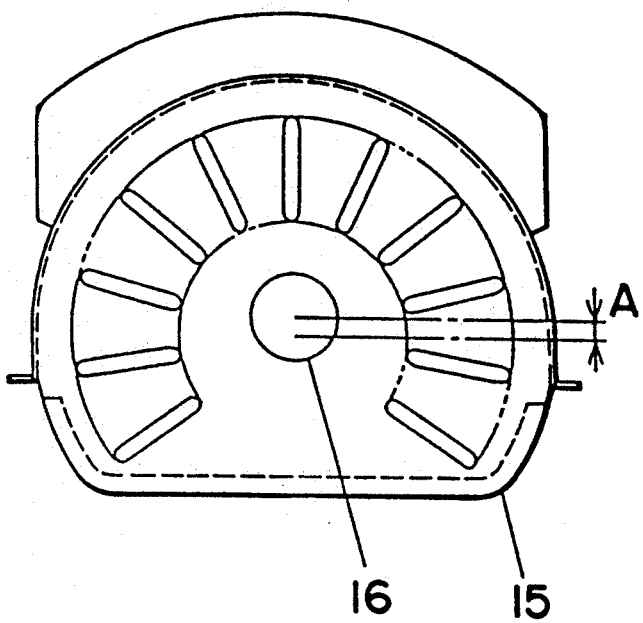
FIG. 5 is a side elevation view of a second modified protecting cover.

In FIG. 5, the dust outlet 16 is offset from the rotational center of the sub-agitator 10. In this arrangement of the dust outlet 16, as the dust passes through the offset dust outlet 16, it is cut short by the edge of the outlet hole 16, and is thereby positively discharged outside.

Figure 6:
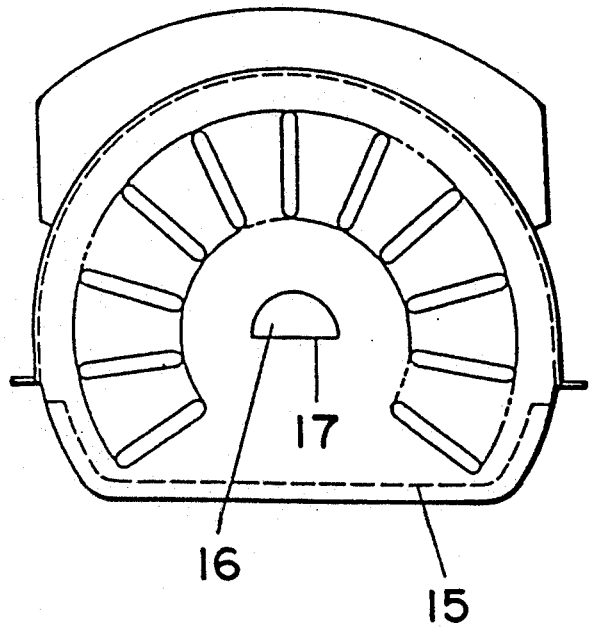
FIG. 6 is a side elevation view of a third modified protecting cover.
Figure 7:
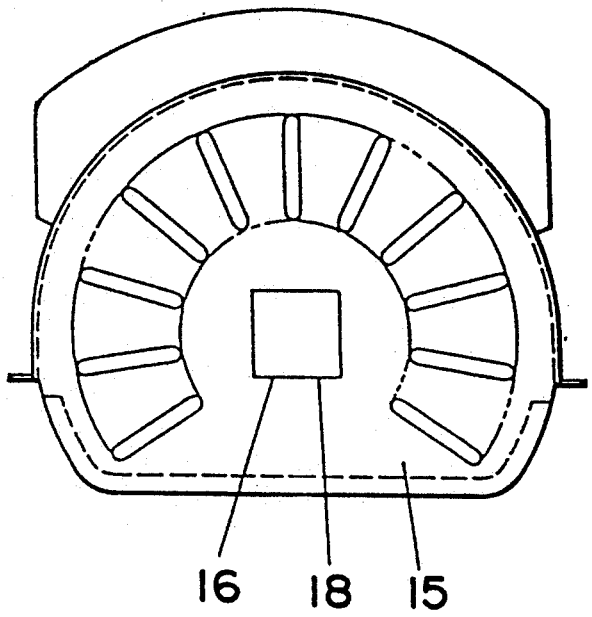
FIG. 7 is a side elevation view of a fourth modified protecting cover.
Figure 8:
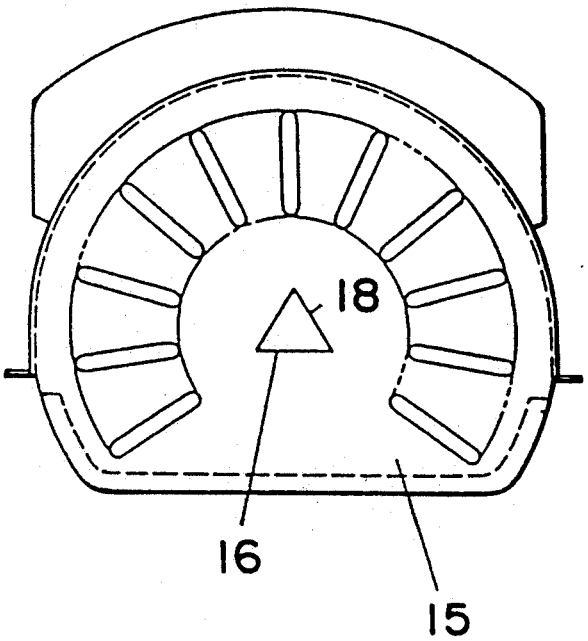
FIG. 8 is a side elevation view of a fifth modified protecting cover.
Figure 9:
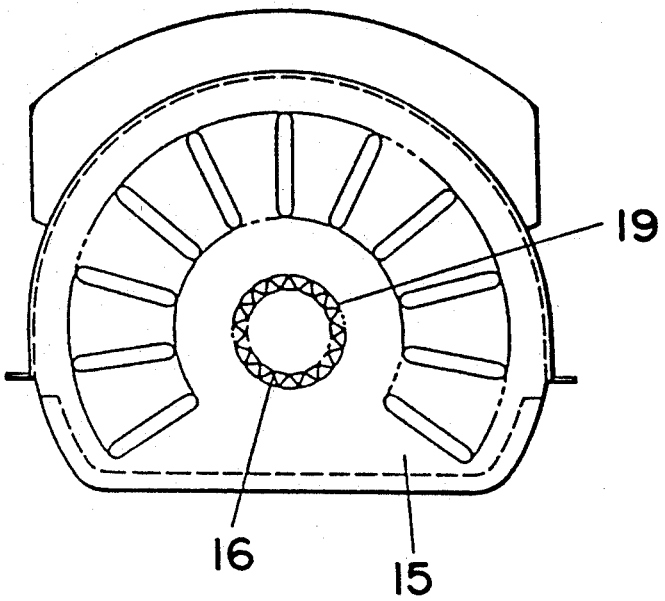
FIG. 9 is a side elevation view of a sixth modified protecting cover.
Figure 10:
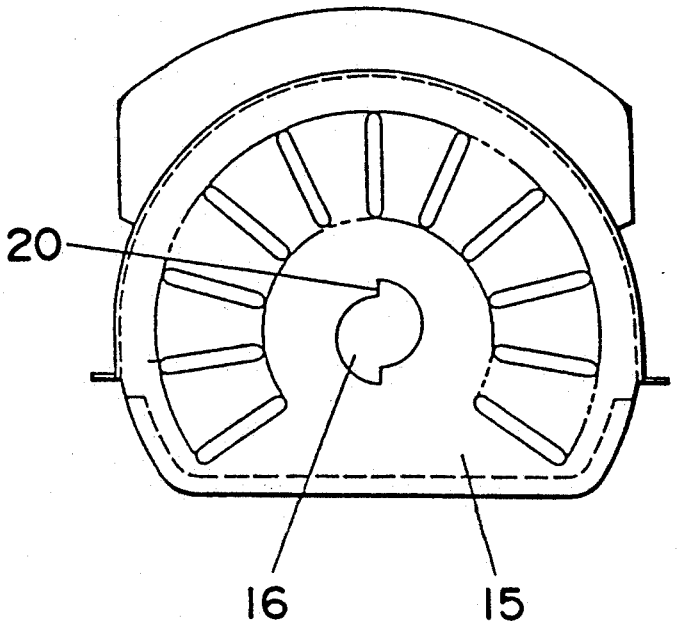
FIG. 10 is a side elevation view of a seventh modified protecting cover.

In FIG. 6, the dust outlet 16 is formed semi-circular, with a straight part 17. On the other hand, the dust outlet 16 in FIGS. 7 and 8 is polygonal, with a straight part 18. A continuous straight part 19 of the dust outlet 16 in FIG. 9 is shaped in sawtooth form. In FIG. 10, a pair of semi-circular holes formed adjacent to and offset are from one another, thereby defining the dust outlet 16. A straight part 20 is formed at a junction between the semi-circular holes. Dust can be cut short at the straight parts 17–20 of the dust outlet 16 when passing through the dust outlet 16. Therefore, positive discharging of dust is ensured.

Figure 11:
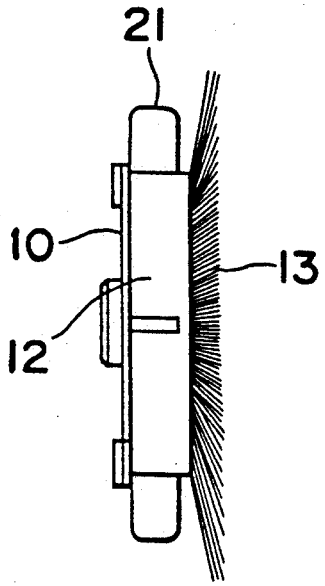
FIG. 11 is a side elevation view of a sub-agitator according to the present invention.

Referring to FIG. 11, a plurality of protruding parts 21 are mounted about the outer periphery of the rotary body 12 laterally inwardly of the stirring member 13 for raking out the dust. Since these protruding parts are in the shape of ribs and are integrally molded about the outer periphery of the rotary body 12, the dust is easily scraped outside during rotation of the protruding parts 21, such that it is prevented from gathering in the gap.

Figure 12:
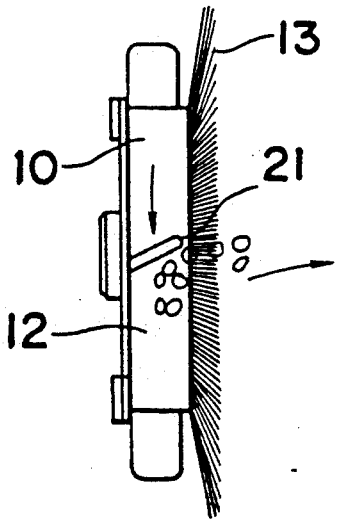
FIG. 12 is a side elevation view of a first modified sub-agitator.

If the protruding part 21 is twisted so that the outer side thereof lags in the rotating direction as shown in FIG. 12, it becomes more certain to rake away the dust to the outside.

Figure 13A:
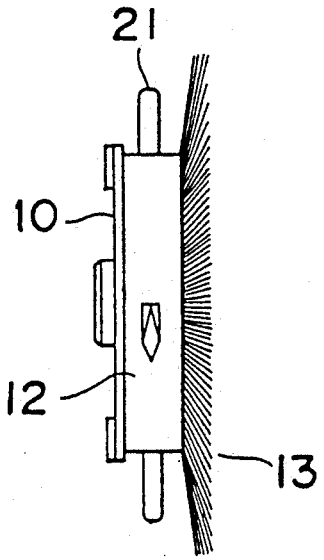
FIG. 13(*a*) is a side elevation view of a second modified sub-agitator.
Figure 13B:
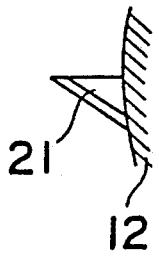

Further, if an end face of the protruding part 21 corresponding to the upper side in the rotating direction is made sharp as illustrated in FIGS. 13(*a*) and (*b*), the dust is cut into shreds.

Figure 14:
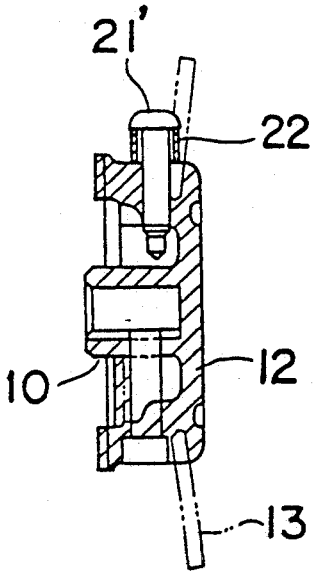
FIG. 14 is a cross-sectional view of a third modified sub-agitator.

A protruding part 21' of FIG. 14 is a metal screw about which a metallic spacer 22 is fitted, so that the protruding part 21' is the same in diameter at and below the head of the screw. Since the protruding part 21' is formed of metal, abrasion thereof is resisted while the durability is enhanced.

As is described hereinabove, the floor nozzle of the present invention is a safety nozzle which prevents the user from being wounded since the sub-agitator (or auxiliary agitator) is covered with the protecting cover. Moreover, the dust gathering in the gap between the protecting cover and sub-agitator can be monitored through the confirmation holes, and therefore the dust can be removed properly. Since the dust will not, therefore, accumulate in the gap, the rotary body of the sub-agitator will not melt due to friction heat caused during rotation. At the same time, the driving source of the agitator is prevented from being broken due to overload. The dust entering the gap between the protecting cover and sub-agitator is guided outside through the dust outlet, thus preventing melting of the rotary body of the sub-agitator or breaking of the driving source. If the dust outlet is offset from the rotational center of the sub-agitator or a straight part is provided at an edge of the outlet, the dust is cut into small pieces to be positively discharged outside. Besides, the protruding part in the outer periphery of the rotary body of the sub-agitator helps to rake away the dust gathering in the gap between the protecting cover and sub-agitator. When the protruding part is twisted or sharpened to function as a cutter, the efficiency of raking the dust can be further improved.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A vacuum cleaner floor nozzle for use in cleaning a floor surface, comprising:

a main nozzle body having opposing ends and an end wall at one of said opposing ends;

a main agitator rotatably mounted in said main nozzle body at one side of said end wall and being adapted to be drivingly rotated by a driving source to scrape dust from the floor surface;

an auxiliary agitator for scraping from the floor surface at a corner of a room, said auxiliary agitator including a rotary body rotatably mounted at an opposite side of said end wall relative to said main agitator and having a periphery, and a stirring member projecting radially from said periphery of said rotary body, said rotary body being operably fixed for rotation with said main agitator about a rotational axis; and a protecting cover mounted at an opposite side of said auxiliary agitator relative to said end wall such that a gap is formed between said protecting cover and said end wall, said auxiliary protecting cover having confirmation holes formed therethrough which define a means for confirming that said gap between said protecting cover and said auxiliary agitator is free of dust.

2. A vacuum cleaner floor nozzle as recited in claim 1, wherein said protecting cover is discrete from said main nozzle body.

3. A vacuum cleaner floor nozzle as recited in claim 1, wherein said protecting cover further has a central portion and a dust outlet formed in said central portion, said dust outlet defining a means for allowing dust collected between said protecting cover and said auxiliary agitator to be discharged.

4. A vacuum cleaner floor nozzle as recited in claim 3, wherein said dust outlet is offset from said rotational axis.

5. A vacuum cleaner floor nozzle as recited in claim 3, wherein said dust outlet has a straight edge formed at one peripheral portion thereof.

6. A vacuum cleaner floor nozzle as recited in claim 3, wherein said dust outlet has a peripheral edge with a saw tooth shape.

7. A vacuum cleaner floor nozzle as recited in claim 1, wherein said auxiliary agitator further includes a projecting part projecting radially from said periphery of said rotary body, said projecting part being disposed between said stirring member and said end wall.

8. A vacuum cleaner floor nozzle as recited in claim 7, wherein said projecting part comprises a rib aligned along an axial direction of said rotational axis.

9. A vacuum cleaner floor nozzle as recited in claim 7, wherein said projecting part comprises a rib inclined relative to an axial direction of said rotational axis.

10. A vacuum cleaner floor nozzle as recited in claim 7, wherein said projecting part includes a leading edge, said leading edge being sharpened.

11. A vacuum cleaner floor nozzle as recited in claim 7, wherein said protecting cover further has a central portion and a dust outlet formed in said central portion, said dust outlet defining a means for allowing dust collected between said protecting cover and said auxiliary agitator to be discharged.

12. A vacuum cleaner floor nozzle as recited in claim 7, wherein said projecting part is formed of metal.

13. A vacuum cleaner floor nozzle as recited in claim 7, wherein said projecting part defines a means for raking dust outwardly of said protecting cover.

14. A vacuum cleaner floor nozzle for use in cleaning a floor surface, comprising:

a main nozzle body having opposing ends and an end wall at one of said opposing ends;

a main agitator rotatably mounted in said main nozzle body at one side of said end wall and being adapted to be drivingly rotated by a driving source to scrape dust from the floor surface;

an auxiliary agitator for scraping dust from the floor surface at a corner of a room, said auxiliary agitator including a rotary body rotatably mounted at an opposite side of said end wall relative to said main agitator and having a periphery and a stirring member projecting radially from said periphery of said rotary body, said rotary body being operably fixed for rotation with said main agitator about a rotational axis; and a protecting cover mounted at an opposite side of said auxiliary agitator relative to said end wall such that a gap is formed between said protecting cover and said end wall, said protecting cover having a central portion, and a dust outlet formed in said central portion thereof, said dust outlet defining a means for allowing dust collected between said protecting cover and said auxiliary agitator to be discharged.

15. A vacuum cleaner floor nozzle as recited in claim 14, wherein said protecting cover is discrete from said main nozzle body.

16. A vacuum cleaner floor nozzle as recited in claim 14, wherein said dust outlet is offset from said rotational axis.

17. A vacuum cleaner floor nozzle as recited in claim 14, wherein said dust outlet has a straight edge formed at one peripheral portion thereof.

18. A vacuum cleaner floor nozzle as recited in claim 14, wherein said auxiliary agitator further includes a projecting part projecting radially from said periphery of said rotary body, said projecting part being disposed between said stirring member and said end wall.

19. A vacuum cleaner floor nozzle as recited in claim 14, wherein said dust outlet has a peripheral edge with a saw tooth shape.

20. A vacuum cleaner floor nozzle for use in cleaning a floor surface, comprising:

a main nozzle body having opposing ends and an end wall at one of said opposing ends;

a main agitator rotatably mounted in said main nozzle body at one side of said end wall and being adapted to be drivingly rotated by a driving source to scrape dust from the floor surface;

an auxiliary agitator for scraping dust from the floor surface at a corner of a room, said auxiliary agitator including a rotary body rotatably mounted at an opposite side of said end wall relative to said main agitator and having a periphery, a stirring member projecting radially from said periphery of said rotary body, and a projecting part projecting radially from said periphery of said rotary body and being disposed between said end wall and said stirring member;

wherein said rotary body is operably fixed for rotation with said main agitator; and wherein said projecting part defines a means for raking dust outwardly of said protecting cover.

21. A vacuum cleaner floor nozzle as recited in claim 20, wherein said projecting part comprises a rib aligned along an axial direction of said rotational axis.

22. A vacuum cleaner floor nozzle as recited in claim 20, wherein said projecting part comprises a rib inclined relative to an axial direction of said rotational axis.

23. A vacuum cleaner floor nozzle as recited in claim 20, wherein said projecting part has a leading edge, said leading edge being sharpened.

24. A vacuum cleaner floor nozzle as recited in claim 20, wherein said projecting part is formed of metal.

* * * * *